US009933125B2

(12) United States Patent
Kuo

(10) Patent No.: US 9,933,125 B2
(45) Date of Patent: Apr. 3, 2018

(54) BULB SIMULATING LIGHT EMITTING DIODE HEADLIGHT

(71) Applicant: Chun-Hsien Kuo, Miaoli County (TW)

(72) Inventor: Chun-Hsien Kuo, Miaoli County (TW)

( * ) Notice: Subject to any disclaimer, the term of this patent is extended or adjusted under 35 U.S.C. 154(b) by 0 days.

(21) Appl. No.: 15/676,565

(22) Filed: Aug. 14, 2017

(65) Prior Publication Data

US 2018/0045391 A1 Feb. 15, 2018

(30) Foreign Application Priority Data

Aug. 15, 2016 (TW) ..... 105125924 A

(51) Int. Cl.

| | |
|---|---|
| ***F21S 8/10*** | (2006.01) |
| ***F21V 29/76*** | (2015.01) |
| ***F21V 23/06*** | (2006.01) |
| ***F21V 23/00*** | (2015.01) |
| ***F21V 23/02*** | (2006.01) |

(Continued)

(52) U.S. Cl.

CPC ..... *F21S 48/115* (2013.01); *F21S 48/1323* (2013.01); *F21S 48/325* (2013.01); *F21S 48/328* (2013.01); *F21V 23/001* (2013.01); *F21V 23/02* (2013.01); *F21V 23/06* (2013.01); *F21V 29/76* (2015.01); *F21V 29/83* (2015.01); *F21Y 2115/10* (2016.08)

(58) Field of Classification Search

CPC .... F21S 48/115; F21S 48/1323; F21S 48/325; F21S 48/328; F21V 29/76; F21V 29/83; F21V 23/001; F21V 23/02; F21V 23/06; F21V 7/0066; F21V 17/00; F21V 17/04; F21V 17/06; F21V 19/00; F21V 19/001; F21V 19/0015; F21V 19/003; F21V 19/0055; F21V 19/0045; F21Y 2115/10

See application file for complete search history.

(56) References Cited

U.S. PATENT DOCUMENTS

| | | | |
|---|---|---|---|
| 9,074,744 | B2 | 7/2015 | Tsukamoto |
| 9,359,539 | B2 | 6/2016 | Osada et al. |
| 2016/0169466 | A1 | 6/2016 | Kuepper et al. |

(Continued)

FOREIGN PATENT DOCUMENTS

| | | | |
|---|---|---|---|
| CN | 203703785 | U | 7/2014 |
| CN | 203857384 | U | 10/2014 |

(Continued)

*Primary Examiner* — Bao Q Truong

(74) *Attorney, Agent, or Firm* — Muncy, Geissler, Olds & Lowe, P.C.

(57) ABSTRACT

A bulb simulating light emitting diode headlight is disposed through a lamp bowl of an illumination device on a vehicle or motorbike body. The bulb simulating light emitting diode headlight includes a main body, a circuit board, and two light emitting diode modules. The main body has a seat, and a first plate and a second plate disposed on the seat. The first and second plates have a first opening and a second opening, respectively, and form a housing space. The circuit board is disposed between the first and second plates. The light emitting diode modules are disposed on two lateral sides of the circuit board and face the first and second openings. When the light emitting diode modules are broken, the user simply picks out the circuit for replacement, without the need of replacing all the components, thus lowering the cost.

10 Claims, 5 Drawing Sheets

(51) Int. Cl.
*F21V 29/83* (2015.01)
*F21Y 115/10* (2016.01)

(56) References Cited

U.S. PATENT DOCUMENTS

| | | | | |
|---|---|---|---|---|
| 2017/0023198 | A1* | 1/2017 | Hsu | F21S 48/115 |
| 2017/0198875 | A1* | 7/2017 | Creusen | F21S 48/1159 |

FOREIGN PATENT DOCUMENTS

| | | | |
|---|---|---|---|
| CN | 204922770 | U | 12/2015 |
| TW | I307975 | B | 3/2009 |
| TW | 200942738 | A1 | 10/2009 |
| TW | I349755 | B | 10/2011 |
| TW | M439129 | U1 | 10/2012 |
| TW | I391267 | B1 | 4/2013 |
| TW | M461004 | U1 | 9/2013 |
| TW | 201428211 | A | 7/2014 |
| TW | M496577 | U | 3/2015 |

* cited by examiner

BULB SIMULATING LIGHT EMITTING DIODE HEADLIGHT

BACKGROUND OF THE INVENTION

1. Field of the Invention

The present invention relates to headlights, and more particularly, to a bulb simulating light emitting diode headlight.

2. Description of the Related Art

Motorbikes and vehicles are highly mobile transportation tool. To improve the driving security, a headlight is a must. A conventional headlight applies a halogen bulb. The halogen bulb provides a greater power; however, the brightness is low, and the service life thereof is relatively short. Therefore, most motorbikes and vehicles apply a light emitting diode headlight which is provided with advantages including lower power, higher brightness, and longer service life.

As shown by US20160169466 "LED H4 Retrofit Lamp Unit", a vehicle headlight with a light emitting diode comprises a support member, two light emitting diodes disposed on two sides of the support member, and a light dissipating device contacted with the support member. The headlight is disposed in a reflector and inclined at an angle from 5 to 30 degrees. With such configuration, the bulb is replaced without additional optic elements. Also, a regulated light form is achieved.

However, such light emitting member is integrally formed. When the light emitting diode is damaged and needs to be replaced, unbroken components such as heat dissipating device, have to be replaced altogether, thus causing a higher cost and a waste of resource.

SUMMARY OF THE INVENTION

For improving the issues above, a bulb simulating light emitting diode headlight, by which other normal components are prevented from being replaced altogether when the light emitting diode is the only broken element.

For achieving the aforementioned objectives, a bulb simulating light emitting diode headlight is provided, which is disposed through a lamp bowl of an illumination device on a vehicle or motorbike body, wherein the lamp bowl comprises a reflection arc face and a through hole formed by the surrounding reflection arc face, the bulb simulating light emitting diode headlight comprising:

a main body, including a seat, and a first plate and a second plate disposed on the seat, the first plate including a first opening, the second plate including a second opening, the first plate and the second plate forming a housing space, the seat passing through the through hole of the lamp bowl, such that the first plate and the second plate are arranged in adjacent to the reflection arc face;

a circuit board disposed between the first plate and the second plate; and two light emitting diode modules disposed on two opposite lateral sides of the circuit board and facing the first opening and the second opening, respectively, wherein the two light emitting diode modules emit a light beam, respectively, such that the light beams are reflected to be projected from the reflection arc face.

With such technical features, the present invention achieves following advantages.

With the circuit board disposed between the first plate and the second plate, for example, in the housing space therebetween, when the light emitting diode modules are broken or damaged and need to be replaced, the user needs to simply pick out the circuit board for carrying out the maintenance process. The main body does not need to be replaced altogether, thus lowering the cost.

Also, when the circuit board or the light emitting diode modules are to be installed or replaced, the user needs to simply conduct the picking or inserting process, thus facilitating the assembling operation.

Also, with the two light emitting diode modules disposed on two opposite lateral sides of the circuit board, respectively, and with the reflection achieved by the reflection arc face, an omnidirectional light is provided.

DETAILED DESCRIPTION OF THE INVENTION

Figure 1:
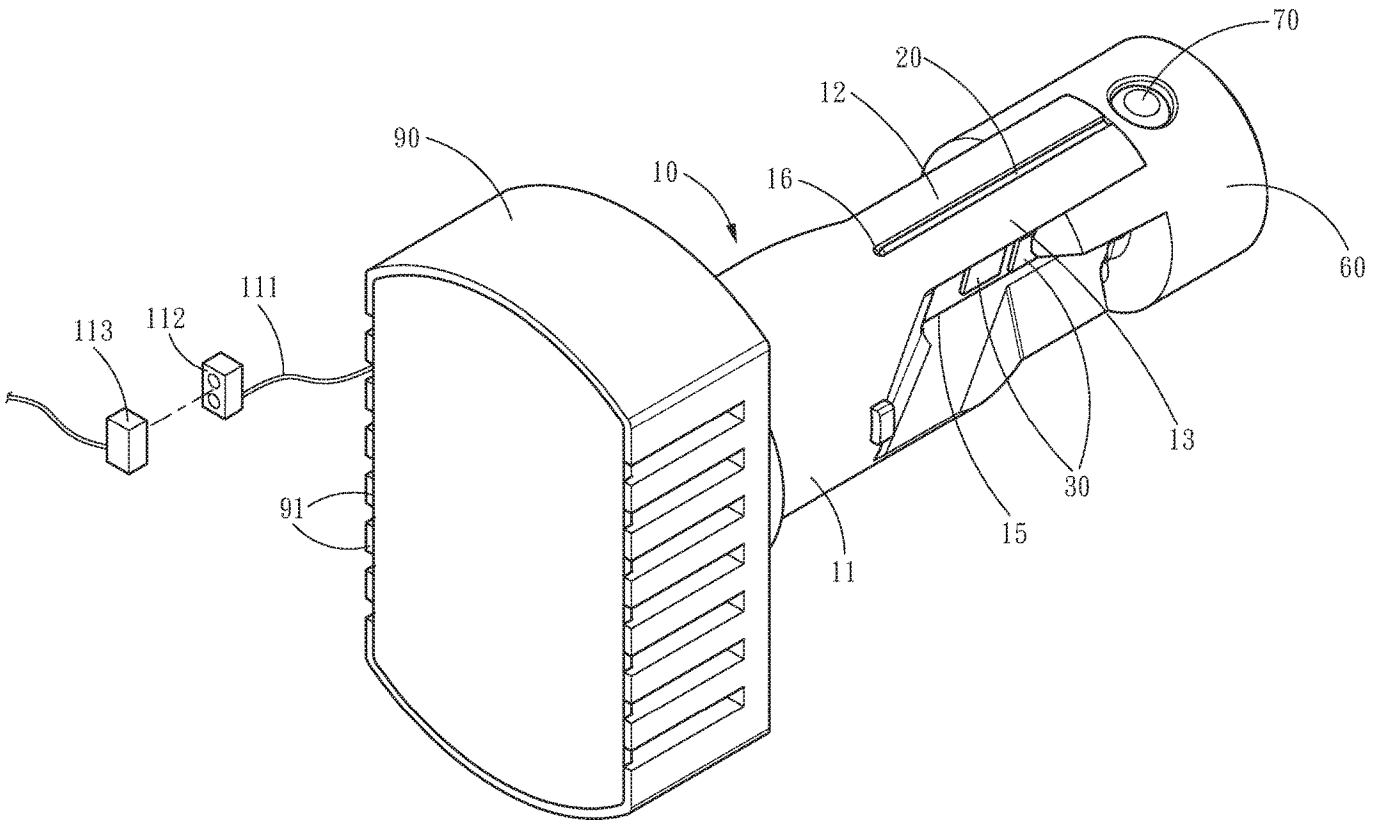
FIG. 1 is a perspective view of a bulb simulating light emitting diode headlight in accordance with an embodiment of the present invention.
Figure 2:
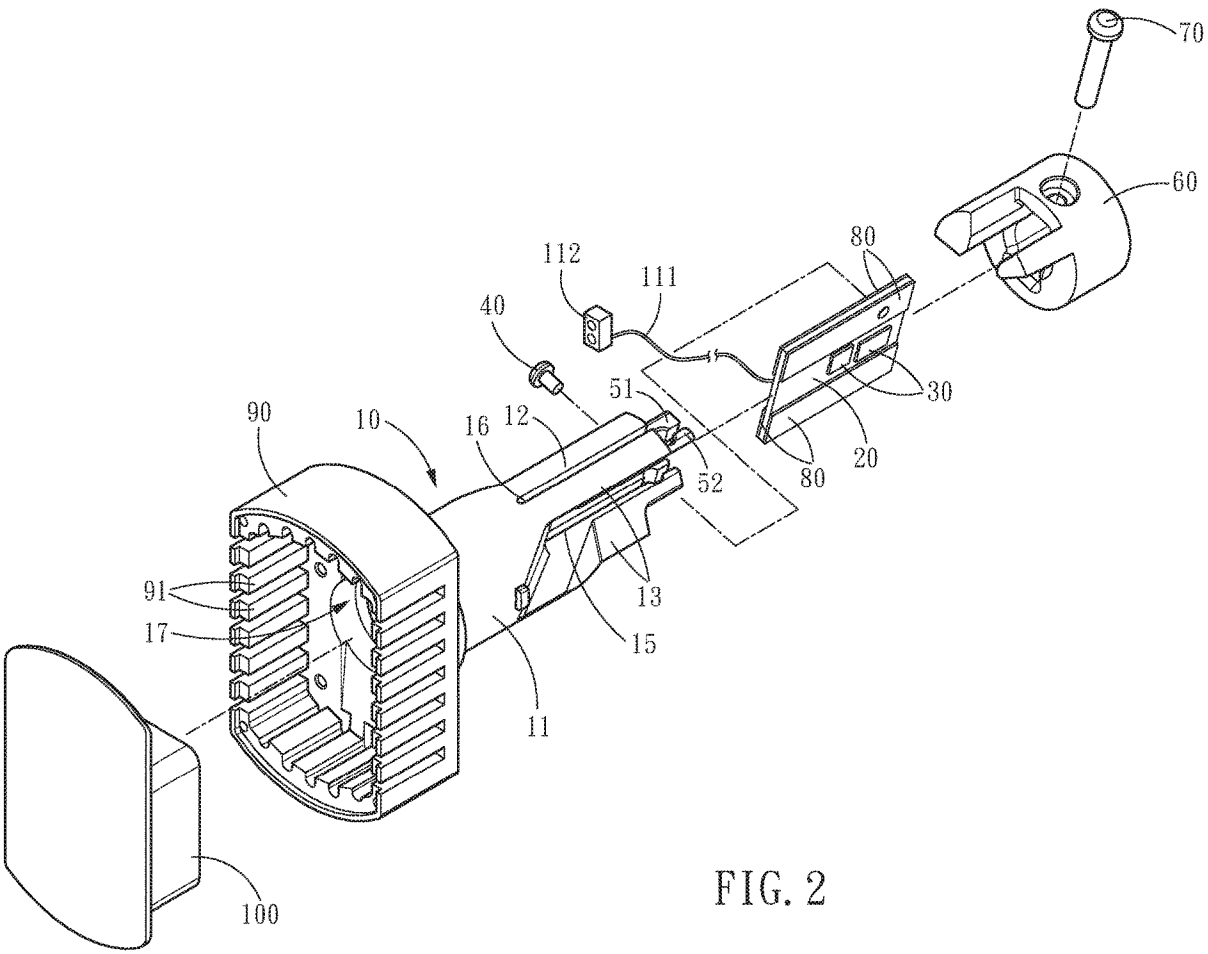
FIG. 2 is an exploded view of the bulb simulating light emitting diode headlight in accordance with an embodiment of the present invention.
Figure 3:
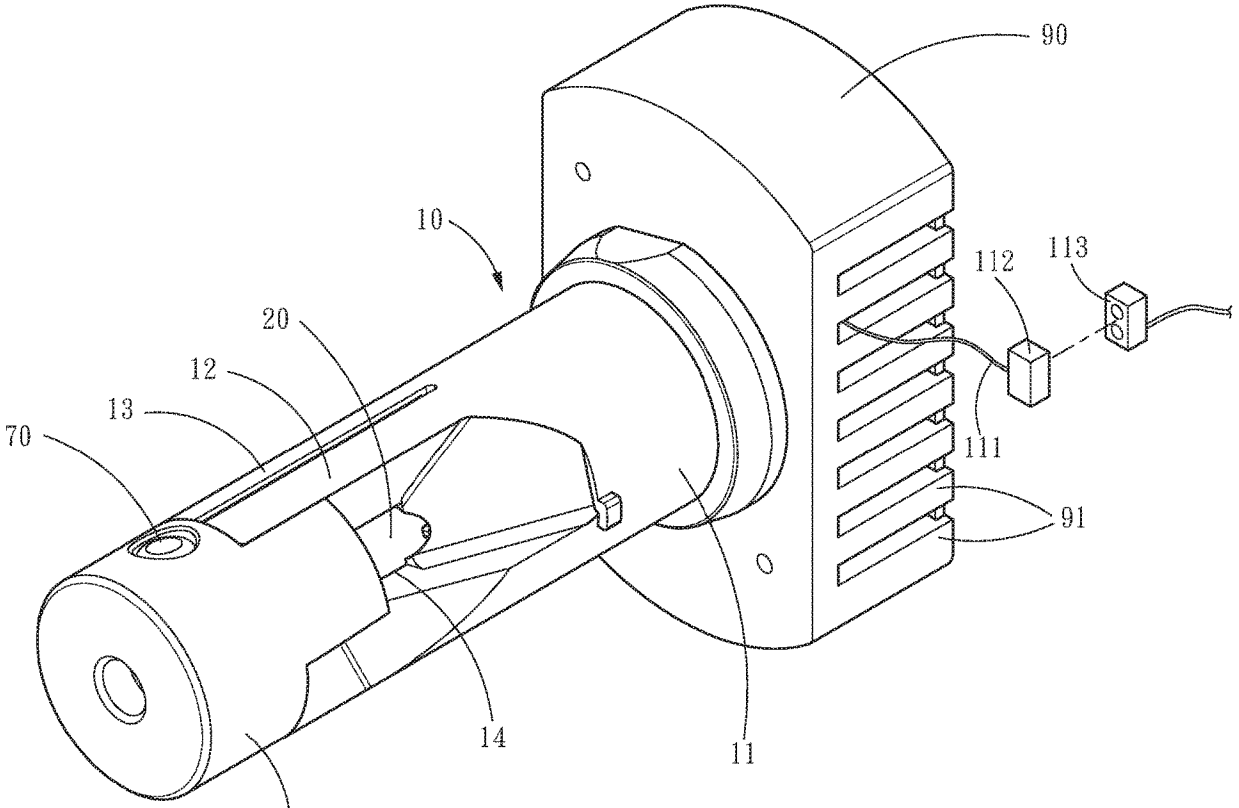
FIG. 3 is another perspective view of the bulb simulating light emitting diode headlight taken from another view point.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 4, the bulb simulating light emitting diode headlight provided by the present invention is disposed through the lamp bowl 1 of an illumination device on a motorbike or vehicle body. The lamp bowl 1 is provided with a reflection arc face 2 and a through hole 3 formed by the surrounding reflection arc face 2. The bulb simulating light emitting diode headlight includes a main body 10, a circuit board 20, and two light emitting diode modules 30.

The main body 10 comprises a seat 11 and a first plate 12 and a second plate 13 disposed on the seat 11. The first plate 12 comprises a first opening 14, and the second plate 13 comprises a second opening 15. Also, a housing space 16 is disposed between the first plate 12 and the second plate 13. The seat 11 passes through the through hole 3 of the lamp bowl 1, such that the first plate 12 and the second plate 13 are arranged in adjacent to the reflection arc face 2. The circuit board 20 is slidably disposed in the housing space 16. The two light emitting diode modules 30 are disposed on two opposite lateral sides of the circuit board 20, respectively, such that the first plate 12 and the second plate 13 faces the first opening 14 and the second opening 15, respectively, to be exposed therefrom. Therefore, when the circuit board 20 or the light emitting diode modules 30 are to be replaced, the user needs to simply pick out or insert the circuit board 20. The main body 10 does not have to be replaced altogether. Thus, the maintenance operation is simplified and facilitated, and the cost of maintenance is lowered. When the assembling process is complete, the light emitting diode modules 30 emit a light beam, respectively, such that the light beams are reflected to be projected from the reflection arc face 2. Also, due to the light emitting diode modules 30 disposed on two opposite lateral sides of the circuit board 20, the light beams are reflected by the reflection arc face 2 to provide an omnidirectional light.

Figure 5:
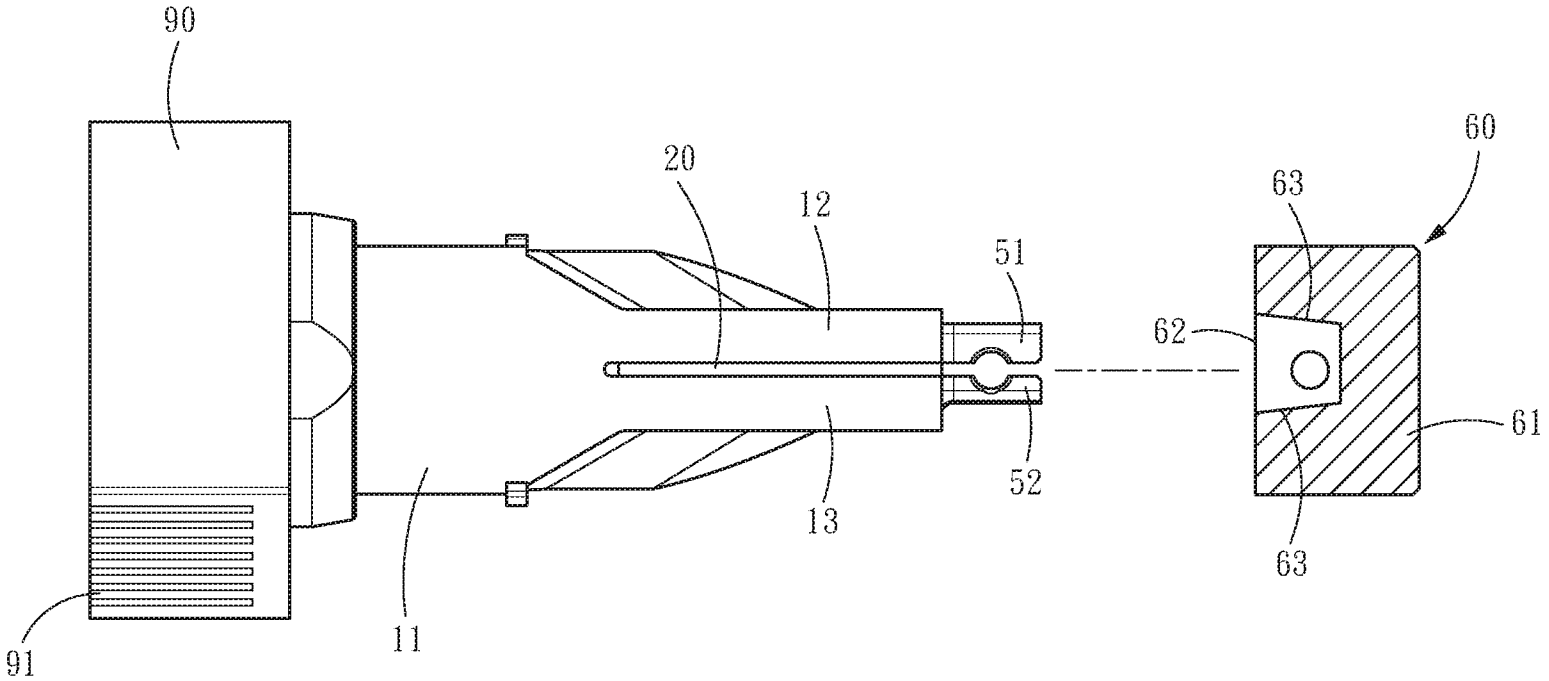
FIG. 5 is a partially sectional view of the bulb simulating light emitting diode headlight in accordance with another embodiment of the present invention.

For securing the circuit board 20, in an embodiment of the present invention, a fixing member 40, a first clamp member 51, a second clamp member 52, a sealing member 60, and a positioning member 70 are further included. The fixing member 40 passes through the circuit board 20, the first plate 12, and the second plate 13, so as to fix the circuit board 20 to the first plate 12 and the second plate 13. The first clamp member 51 and the second clamp member 52 are disposed on one end of the first plate 12 and the second plate 13 away from the seat 11, respectively, and the sealing member 60 is applied for fixing the first clamp member 51 and the second clamp member 52. In an embodiment of the present invention, the sealing member 60 is designed to have an inner diameter slightly smaller than the distance between the first clamp member 51 and the second clamp member 52, so as to force the first clamp member 51 and the second clamp member 52 to move toward each other, whereby the first plate 12 and the second plate 13 stably clamp the circuit board 20. Alternatively, as shown by FIG. 5, the sealing member 60 is provided with a cover 61, a notch 62, and a side wall 63 extending from the cover 61 toward the notch 62. Also, the side wall 63 is forms a slope tapering from the notch 62 toward the cover 61, so as to force the first clamp member 51 and the second clamp member 52 to clamp intensively. In addition, the sealing member 60 seals encloses the housing space 16 to prevent the circuit board 20 from sliding to be detached. For further positioning the circuit board 20, the positioning member 70 passes through the first clamp member 51, the second clamp member 52, and the sealing member 60 at the same time, so as to ensure the positioning effect.

Furthermore, a heat dissipating member 90, a thermal grease 80, and a fan 100 are included. The thermal grease 80 is disposed between first plate 12 and the circuit board 20 and between the second plate 13 and the circuit board 20, so as to improve the heat conductivity thereof, whereby the heat is efficiently conducted to the first plate 12 and the second plate 13. The heat dissipating member 90 is disposed on one side of the seat 11 away from the housing space 16. The heat dissipating member 90 includes a plurality of heat dissipating fins 91 away from the seat 11 for improving the heat dissipation. The fan 100 is disposed on one side of the heat dissipating member 90 away from the seat 11, and connected with a tunnel 17 which communicates with the first opening 14 and the second opening 15, so as to blow an air flow toward the circuit board 20 for improving the heat dissipating efficiency.

When assembling or replacing the circuit board 20, the user needs to simply remove the fixing member 40, the sealing member 60, and the positioning member 70, and subsequently pick out the original circuit board 20 and finally insert a new circuit board 20. The circuit board 20 is connected with an external power source 113 through a conductive extension wire 111 and an electrical connection member 112. The conductive extension wire 111 passes through the tunnel 17, and the electrical connection member 112 is disposed on one end of the conductive extension wire 111 away from the circuit board 20, such that the electrical connection member 112 is connected with the external power source 113. Therefore, the required power is provided for facilitating the operation. Also, the fan 100 is allowed to be integrated to be driven during the operation of the circuit board 20.

Figure 4:
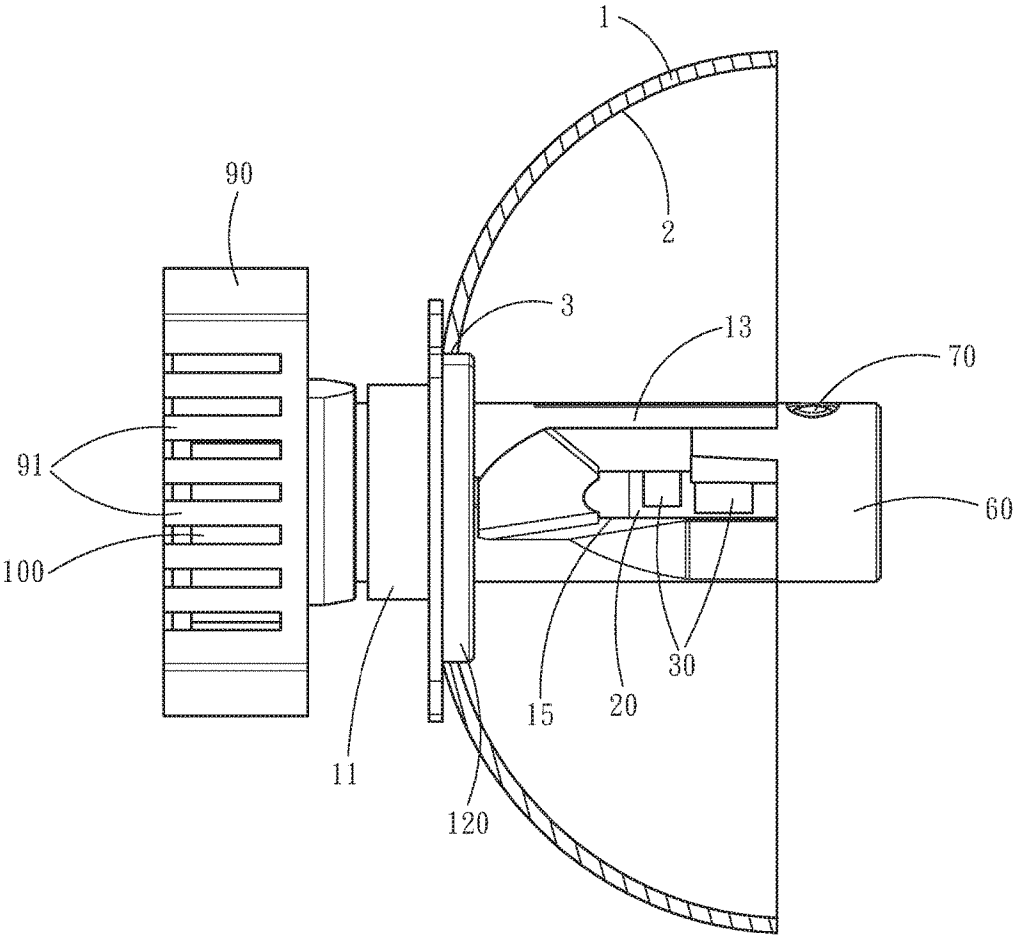
FIG. 4 is a partially sectional view illustrating the application status of the bulb simulating light emitting diode headlight.

Referring to FIG. 4, when the bulb simulating light emitting diode headlight is disposed in the lamp bowl 1, an engagement member 120 is additionally installed on the seat 11 to be fixed on the through hole 3 of the lamp bowl 1.

With such configuration, the present invention achieves the following advantages.

When the two light emitting diode modules 30 are broken or damaged and need to be replaced, the user needs to simply pick out the circuit board 20 for carrying out the replacing process. The main body 10 does not need to be replaced altogether, thus lowering the cost.

With the two light emitting diode modules 30 disposed on two opposite lateral sides of the circuit board 20, respectively, and with the reflection achieved by the reflection arc face 2, an omnidirectional light is provided By use of the fixing member 40, the first clamp member 51, the second clamp member 52, the sealing member 60, and the positioning member 70, the circuit board 20 is stably secured.

By use of the heat dissipating member 90, the thermal grease 80, and the fan 100, the heat dissipation is improved.

When assembling or replacing the circuit board 20, the user needs to simply remove the fixing member 40, the sealing member 60, and the positioning member 70, and subsequently pick out the original circuit board 20 and insert a new circuit board 20. Usage of the present invention is facilitated.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bulb simulating light emitting diode headlight which is disposed through a lamp bowl of an illumination device on a vehicle or motorbike body, wherein the lamp bowl comprises a reflection arc face and a through hole formed by the surrounding reflection arc face, the bulb simulating light emitting diode headlight comprising:

a main body, including a seat, and a first plate and a second plate disposed on the seat, the first plate including a first opening, the second plate including a second opening, the first plate and the second plate forming a housing space, the seat passing through the through hole of the lamp bowl, such that the first plate and the second plate are arranged in adjacent to the reflection arc face;

a circuit board disposed between the first plate and the second plate; and two light emitting diode modules disposed on two opposite lateral sides of the circuit board and facing the first opening and the second opening, respectively, wherein the two light emitting diode modules emit a light beam, respectively, such that the light beams are reflected to be projected from the reflection arc face.

2. The light emitting diode headlight of claim 1, further comprising a fixing member, the fixing member applied for fixing the circuit plate with the first plate and the second plate.

3. The light emitting diode headlight of claim 1, further comprising a first clamp member, a second clamp member, and a sealing member, wherein the first clamp member is disposed on one end of the first plate away from the seat, the second clamp member is disposed on one end of the second plate away from the seat, and the sealing member fixes the first clamp member and the second clamp member and seals the housing space.

4. The light emitting diode headlight of claim 3, wherein the sealing member includes a cover, a notch, and a side wall extending from the cover toward the notch, the side wall is forming a slope tapering from the notch toward the cover.

5. The light emitting diode headlight of claim 3, further comprising a positioning member passing through the first clamp member, the second clamp member, and the sealing member for further securing such components.

6. The light emitting diode headlight of claim 1, further comprising a thermal grease disposed between the first plate and the circuit board and between the second plate and the circuit board.

7. The light emitting diode headlight of claim 1, further comprising a heat dissipating member disposed on one side of the seat away from the housing space.

8. The light emitting diode headlight of claim 7, further comprising a fan disposed on one side of the heat dissipating member away from the seat, the seat including a tunnel communicating with the first opening and the second opening, the fan correspondingly connected with the tunnel.

9. The light emitting diode headlight of claim 7, wherein the heat dissipating member includes a plurality of heat dissipating fins disposed away from the seat.

10. The light emitting diode headlight of claim 1, wherein the seat includes a tunnel communicating with the first opening and the second opening, and the circuit board further includes a conductive extension wire and an electrical connection member, the conductive extension wirepassing through the tunnel, the electrical connection member disposed on one end of the conductive extension wire away from the circuit board and connected with an external power source.

* * * * *